US007059747B2

(12) United States Patent
Barozzini et al.

(10) Patent No.: US 7,059,747 B2
(45) Date of Patent: Jun. 13, 2006

(54) SHUTTER MECHANISM FOR FLOODLIGHT, WITH DRIVE

(75) Inventors: Claude Barozzini, Austin, TX (US); Greg Charlston, Converse, TX (US); Kurt Christensen, Lockhart, TX (US); Troy Lumpkin, New Braunfels, TX (US)

(73) Assignee: Genlyte Thomas Group LLC, Louisville, KY (US)

( * ) Notice: Subject to any disclaimer, the term of this patent is extended or adjusted under 35 U.S.C. 154(b) by 0 days.

(21) Appl. No.: 10/653,433

(22) Filed: Sep. 2, 2003

(65) Prior Publication Data

US 2004/0090782 A1 May 13, 2004

Related U.S. Application Data

(60) Provisional application No. 60/407,805, filed on Sep. 3, 2002.

(51) Int. Cl.
*F21V 11/18* (2006.01)

(52) U.S. Cl. ..... 362/277; 362/351

(58) Field of Classification Search ..... 362/18, 362/280, 321, 3, 16, 257, 277, 317, 319, 362/351, 359, 129.12; 251/129.1, 129.11, 251/129.04, 193, 194, 213, 264, 248–250, 251/318, 319, 326

See application file for complete search history.

(56) References Cited

U.S. PATENT DOCUMENTS

| | | | | | |
|---|---|---|---|---|---|
| 260,933 | A | * | 7/1882 | Brassill | 362/280 |
| 1,186,495 | A | * | 6/1916 | Pini | 362/18 |
| 1,515,724 | A | * | 11/1924 | Brenkert et al. | 362/321 |
| 2,008,938 | A | | 7/1935 | Tolhurst | |
| 2,439,330 | A | * | 4/1948 | Zander | 359/234 |
| 2,509,438 | A | * | 5/1950 | Kennelly | 362/288 |
| 2,650,292 | A | * | 8/1953 | Strong | 362/268 |
| 3,484,599 | A | * | 12/1969 | Little | 362/268 |
| 3,783,263 | A | | 1/1974 | Cruse | |
| 3,941,349 | A | * | 3/1976 | Pierson | 251/326 |
| 4,101,957 | A | * | 7/1978 | Chang | 362/268 |
| 4,151,584 | A | * | 4/1979 | Labrum | 362/302 |
| 4,200,902 | A | * | 4/1980 | Intrator | 362/18 |
| 4,232,359 | A | * | 11/1980 | Leon et al. | 362/268 |
| 4,253,483 | A | * | 3/1981 | Cornelius | 251/129.12 |
| 4,610,430 | A | * | 9/1986 | Besnard et al. | 251/326 |
| 4,875,504 | A | * | 10/1989 | Nicholson | 251/129.12 |
| 4,899,267 | A | * | 2/1990 | Mardon | 362/321 |
| 5,003,943 | A | * | 4/1991 | Lafferty, Sr. | 251/326 |
| 5,053,934 | A | | 10/1991 | Krebs | |
| 5,205,317 | A | * | 4/1993 | Neuerberg et al. | 251/328 |

(Continued)

*Primary Examiner*—Sandra O'Shea
*Assistant Examiner*—Ismael Negron
(74) *Attorney, Agent, or Firm*—James E. Cole; Middleton Reutlinger

(57) ABSTRACT

The shutter drive mechanism and floodlight has an outer housing which surrounds the light fixture and also which protects the light fixture and a drive mechanism from the elements. Extending outward from the housing is a drive veil which supports the drive mechanism for raising and lowering a rigid shutter which covers the lens of the light fixture so that the light may be doused readily without turning off the lamp. The planar shutter moves horizontally or vertically within rails through a first and second slide, the shutter moveable by a drive arm which is affixed to a runner retained within a runner guide and driven by a screw drive. The shutter is actuatable between an opened and closed position such that the light fixture is adequately doused while the lamp remains on.

35 Claims, 4 Drawing Sheets

U.S. PATENT DOCUMENTS 5,271,426 A * 12/1993 Clarkson et al. ..... 251/328
5,353,211 A * 10/1994 Merko ..... 362/294
5,370,149 A * 12/1994 Clarkson et al. ..... 251/328
5,678,802 A * 10/1997 Lunder ..... 251/294
5,887,970 A * 3/1999 Payne ..... 362/321
6,168,291 B1 1/2001 Rockey et al.
6,408,886 B1 * 6/2002 Milano et al. ..... 251/129.11

* cited by examiner

SHUTTER MECHANISM FOR FLOODLIGHT, WITH DRIVE

CROSS-REFERENCE TO RELATED APPLICATIONS

This application is a non-provisional utility application, which claims the benefit of U.S. Provisional Application No. 60/407,805, filed Sep. 3, 2002.

TECHNICAL FIELD

The present invention relates to lighting fixtures and also to shutter systems for lighting systems for dousing of the lights.

Many different designs for shutter systems for light systems have been previously utilized in order to quickly douse lights without actually turning off the light emission source from within the light system. Such systems may be desirable particularly when a light source is utilized that requires warm up time to reach full energy or lumen output. These systems are utilized in theatrical or other specialized display environments, both indoors and outdoors, where repeated cyclical light emissions are desired and wherein high energy output lights are implemented.

DETAILED DESCRIPTION OF THE PREFERRED EMBODIMENTS

Figure 1:
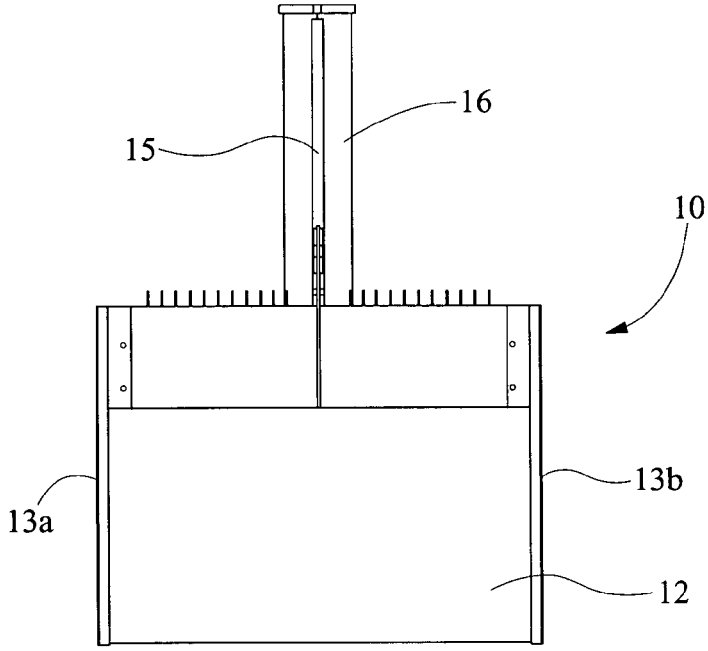
FIG. 1 is a front view of the shutter drive mechanism for an outdoor floodlight of the present invention.
Figure 2:
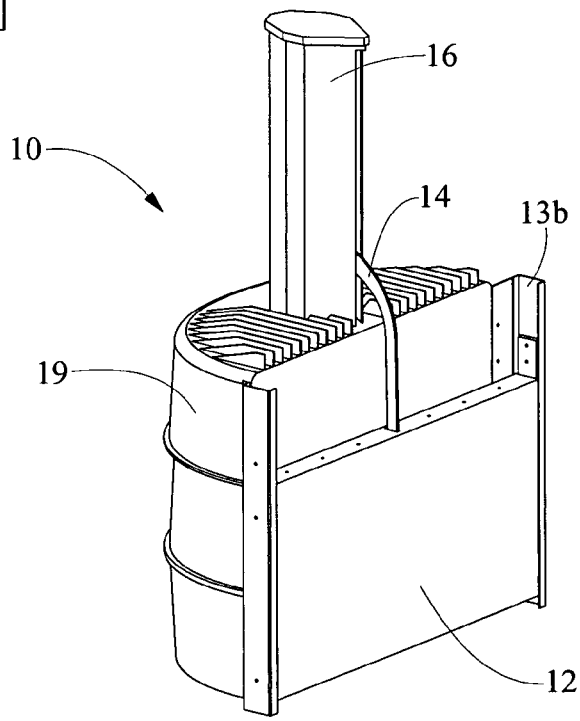
FIG. 2 is a perspective view of the shutter drive mechanism and outdoor floodlight depicted in FIG. 1.

The shutter drive mechanism for dousing of an outdoor floodlight 10 of the present invention is shown in the frontal view of FIG. 1 and perspective view of FIG. 2. As shown therein, a housing 19 may surround the floodlight and reflector mechanism as well as the drive mechanism for the drive arm 14. Housing 19 may extend around the rear portion of the floodlight 10 while having on the front side thereof a shutter 12 which moves within rails 13*a* and 13*b*. Planar shutter 12, as shown in FIG. 1 and in FIG. 2, moves vertically within rails 13*a* and 13*b* as positioned by drive arm 14 and may be a rigid planar shutter made of aluminum or other material. Drive arm 14 is received within a slot 15 of the drive veil 16 and is moved by a drive mechanism retained within the veil 16 extending above the main portion of the housing 19. The shutter 12, as depicted in the embodiment shown, moves vertically in order to quickly douse the light without resorting to removing power to the light source contained therein. Thus, the light may be turned on and off by actuation of the shutter 12 without necessarily turning off the lamp. Further, while the light is doused and the lamp is still on, the characteristics of the fixture are such that it will not overheat merely because the front of the fixture is covered by the shutter. The planar shutter 12 also acts so that the floodlight lens 27 and possibly the light source retained therein is protected from the elements and possible high winds. Thus, a light fixture may be placed in the interior of the housing 19 which may protect the light source and drive mechanism from the elements by a rain shield or other desirable material. The housing 19 may be protected by a Nomex rain shield or other similar material and may be mounted atop or around a luminaie while having the drive veil and drive system extending upward therefrom. The light source within the fixture may be an outdoor floodlight such as a 1000 watt metal halide having a standard reflector assembly.

Figure 3:
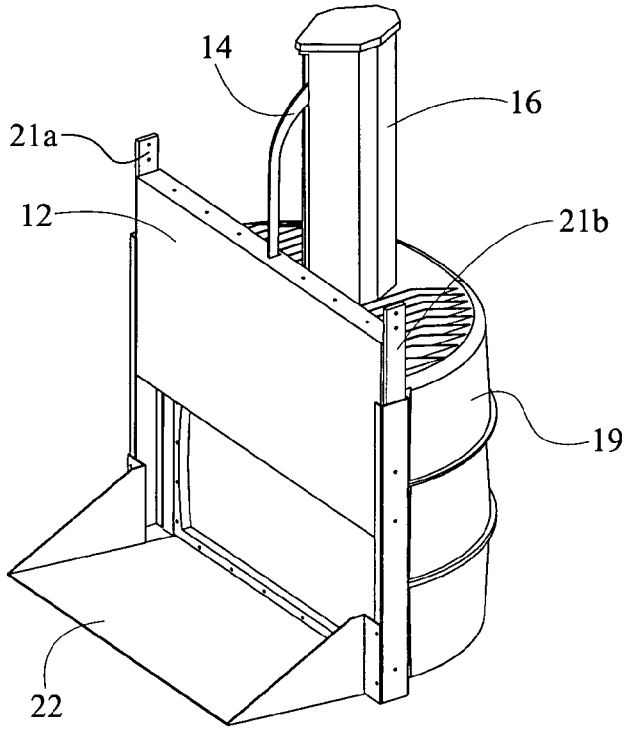
FIG. 3 is a perspective view of the shutter drive mechanism and outdoor floodlight of the present invention with the shutter in the open position.
Figure 4:
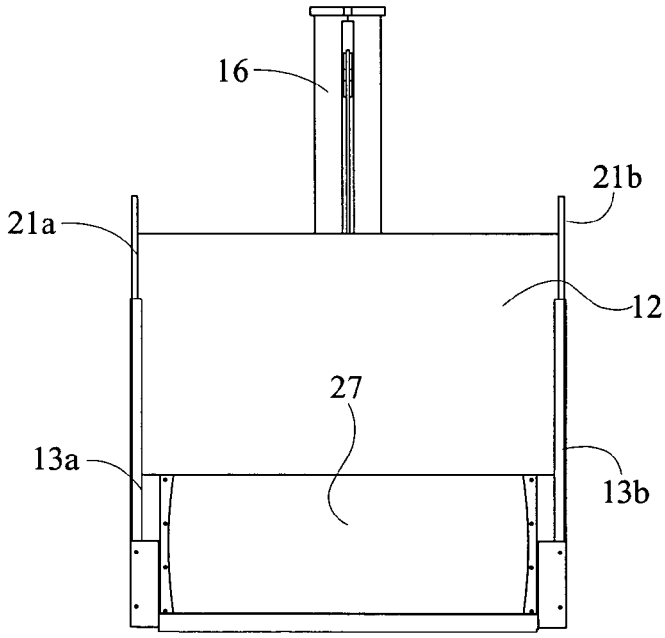
FIG. 4 is a front view of the shutter drive mechanism and outdoor floodlight of the present invention as depicted in FIG. 3.

As detailed in FIGS. 3 and 4, the shutter 12 is in the raised position and rides within rails 13*a* and 13*b*. Shutter 12 has ball bearing slides 21*a* and 21*b* so that it may move within the rails 13*a* and 13*b* with relative ease such that the shutter 12 may be raised or lowered by drive arm 14. Ball bearing slides 21*a* and 21*b* may be alternative slides or movement mechanisms within rails 13*a* and 13*b* and are provided herein as exemplary only. Various rail and slide mechanisms may be utilized interchangeably herewith and are felt to be incorporated by the teachings of the present application such that the vertical or planar shutter 12 covers the light emission area of the lamp contained within the fixture housing.

As seen from the figures, housing 19 may encircle the luminaire, floodlight or light fixture contained therein while also protecting the drive motor or mechanism which may provide force to drive arm 14. The housing 19 may also alternatively have a front visor 22 so that the glare from the light source may be reduced or obstructed to those viewing the fixture 10 from below or at an angle. Drive mechanism 35 may extend outward from the housing or may be retained therein and powered by a motor contained internally or externally of the housing 19. Additionally, the placement of the drive mechanism and shutter 12 as depicted are provided as exemplary only as the horizontal movement of the planar shutter 12 is provided herein to properly describe the present inventive shutter drive mechanism for an outdoor floodlight. Alternative constructions and movement in the horizontal diagonal or vertical plane of the shutter 12 falls within the teachings herein.

As shown in the figures, drive veil 16 extends upward from the rear portion of the housing 19 such that the drive mechanism contained therein is protected from the elements. The drive arm 14 slides within slot 15 of drive veil 16. Slot 15 may have on either side a protective rubber gasket or seal to prevent the flow of water or other elements to the interior of drive veil 16. The planar shutter 12 may be constructed of aluminum, plastic or other material and may, if desirable, be of sufficient structural strength or rigidity to protect the lens and light fixture from the elements. As shown in FIGS. 1–4, the planar shutter 12 may move within the rails 13*a* and 13*b* such that the light is reduced significantly or eliminated when the shutter is placed in the closed position. The lens 27 and the internal components of the outdoor light fixture or floodlight may also be protected by placing the shutter 12 in the closed position. However, it may merely be desirable that the shutter system simply provide a method for eliminating or significantly reducing the light output of the fixture 10 without resorting to turning off the lamp source contained therein. It also may be desirable that multiple brackets on the exterior of the housing 19 may be provided for proper mounting or positioning of the outdoor floodlight 10 of the present invention.

Figure 5:
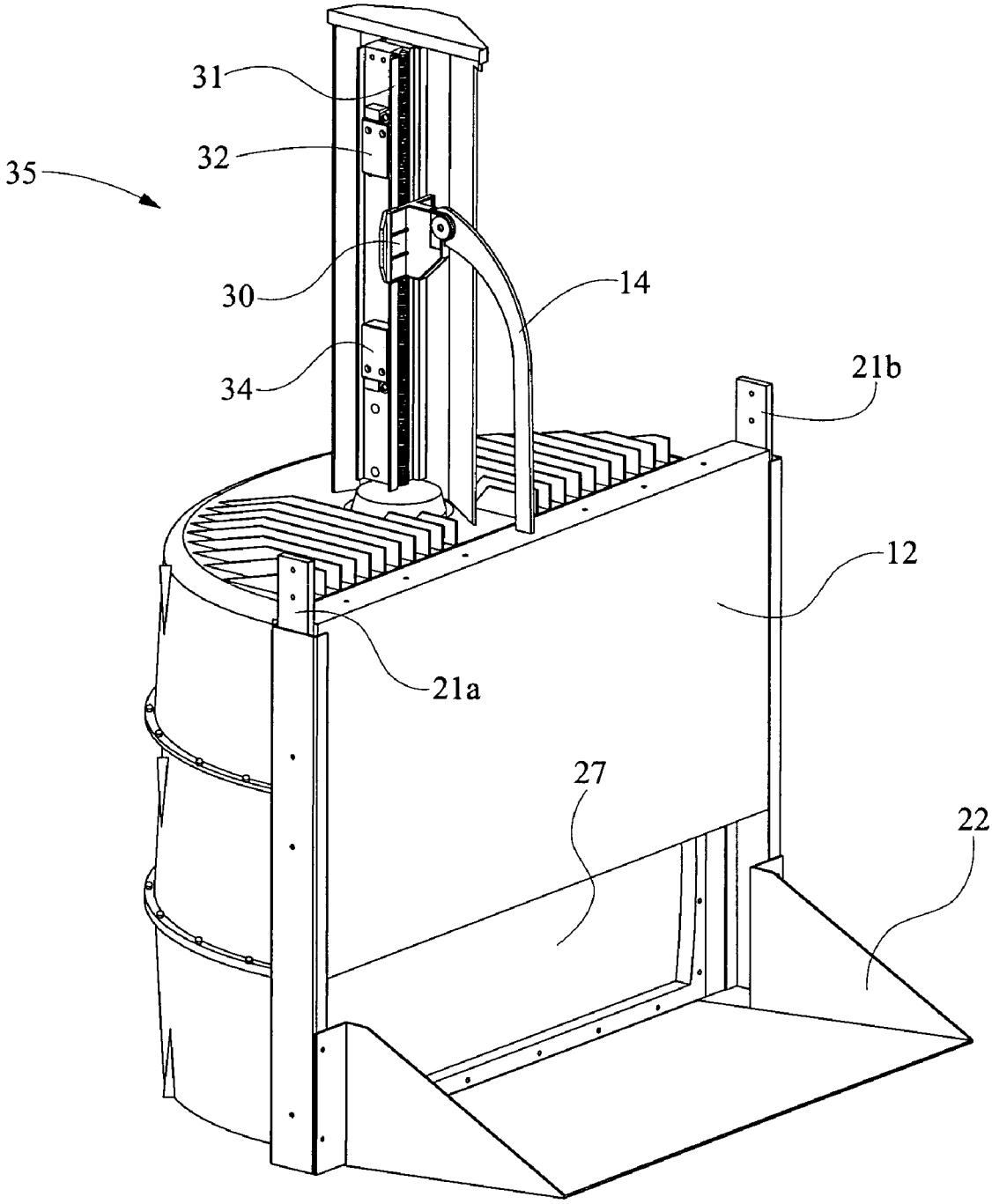
FIG. 5 is a partial sectional view of the shutter drive mechanism of the present invention; and, FIG. 6 is a sectional view of the shutter drive mechanism of the present invention.
Figure 6:
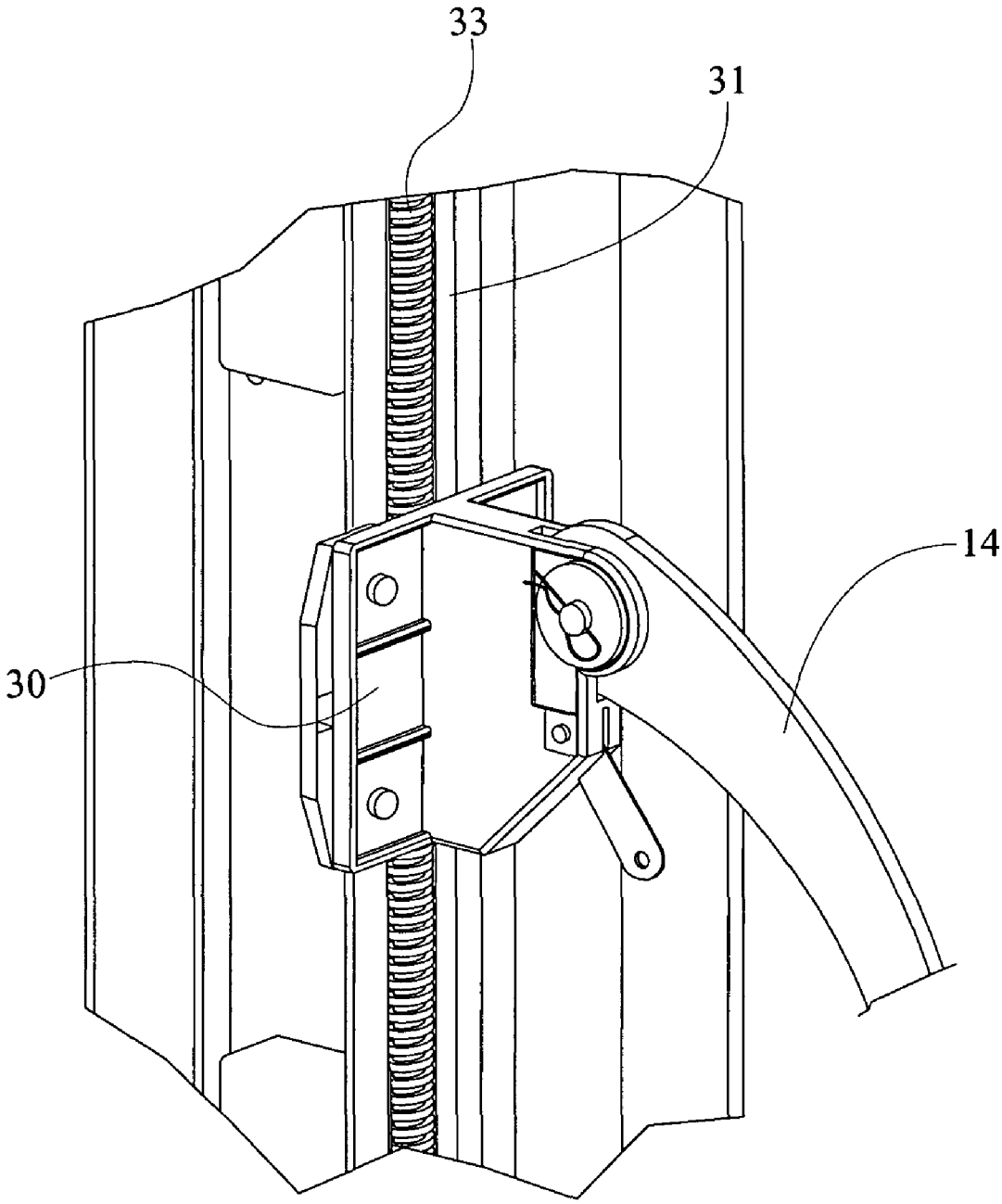

Turning to FIG. 5 in relation to the previously discussed figures, the drive mechanism 35 of the present invention may be shown. As depicted therein, the drive arm 14 may be affixed to a runner 30 which moves within the runner guide casting 31 between the upper limit switch 32 and lower limit switch 34. The runner 30 may be directly affixed to a screw drive 33 contained within the runner guide casting 31 as shown in FIG. 6 so that the drive arm 14 and runner 30 moves between upper and lower limit switches 32 and 34. As depicted in FIG. 6, screw drive 33 may be utilized which rotates in both the clockwise and counter-clockwise direction in order to properly move the runner 30 up and down. Screw drive 33 may be retained within the interior of runner guide 31 and may be powered by an electric motor or other drive system contained within the housing 19. The drive mechanism 35 depicted in FIG. 5 allows for the easy transitioning of the planar shutter 12 from the open to the closed position. Drive mechanism 35 as depicted may be similar to a standard garage door opener drive system wherein the runner moves laterally between two defined positions. In the present inventive design, the screw drive 33 may be about 2 feet long and the runner 30 may travel between open and closed positions about 1.6 inches, depending on the amount of travel necessary to place the shutter 12 in either the fully closed position or the fully opened position. The screw drive 33 may be driven by a ½ HP electric motor. Electrical contact trigger or switches may be implemented to set the upper and lower limit positions and for proper opened and closed position of the shutter.

The runner 30 may be placed, as depicted in the figures, within a groove on the guide 31 such that it is in contact with the screw drive and may be in threaded contact therewith in order to travel vertically up and down the guide 31. Thus, as the screw drive 33 rotates in the clockwise or counter clockwise direction, runner 30 travels the length of the guide 31 until limit switches are contacted by the runner 30 thereby deactivating the motor or other mechanism driving the screw drive 33.

It may be desirable in many circumstances in order to enshroud a floodlight or outdoor light fixture in a protective casing. In instances where the light fixture or floodlight is exposed to severe conditions, additional protection may be required such that a shutter mechanism is provided for opening and closing of the light fixture thereby exposing the lens and/or light assembly. Such assembly however must provide sufficient functionality to work in extreme conditions while also assuring repeated use and dependability as the positioning of the outdoor fixture may be such that it not readily accessible. The light fixture and shutter drive mechanism of the present invention provides such functionality by allowing a rigid planar shutter to be directly attached to a drive arm and drive mechanism in order to readily douse a light without having to turn the lamp on and off. Alternatively, upon activation of the illumination source within the fixture, the drive mechanism contained therein can be activated thereby opening the shutter to expose the illumination source or lens if mere protection of the lens or light source is desired. Upon deactivation of the light source, the shutter can be lowered or positioned in a closed manner so that the interior portions of the light fixture are protected.

The drive mechanism 35 as depicted in FIG. 5 and in FIG. 6 is comprised of an electric motor which turns a screw drive 33. The screw drive 33 allows the runner 30 to move vertically within the runner guide 31 between the limit switches 32 and 34. It is appreciated however that both vertical and horizontal drive mechanisms may be provided and may be constructed of alternative sources such as gears or belt drives. Such alternative constructions are felt to fall within the teachings of the present invention and no unnecessary limitation is to be interpreted from the specific drive mechanism disclosed herein. Alternative drive mechanisms are available to one of ordinary skill in the art and may be used interchangeably with the generalized teachings of the planar shutter drive mechanism for an outdoor floodlight depicted herein.

The shutter drive mechanism for an outdoor floodlight of the present invention is comprised of a light fixture having a light emitting source contained therein, the light fixture surrounded by a housing, the housing also surrounding a drive motor or other power source, a planar shutter moveably retained over an opening of the housing or front of the light source, the planar shutter moveably retained within a first and a second rail, the planar shutter affixed to a drive arm, the drive motor reciprocating a runner within a runner guide, said runner affixed to said drive arm and positionable between an upper limit and a lower limit, said shutter moveable within said rails to fully enclose said housing and said light emitting source contained therein. The drive mechanism may be an electric motor powering a screw drive within the runner guide. The runner may be threadably attached to the screw drive and travel the length of the guide as the screw drive rotates in the clockwise or counter clockwise direction thereby forcing the planar shutter in the open or closed position to properly douse the light or allow light to fully emanate therefrom.

The foregoing detailed description is given primarily for clearness of understanding and no unnecessary limitations are to be understood therefrom for modifications will become obvious those skilled in the art upon reading this disclosure and may be made without departing from the spirit of the invention and scope of the appended claims.

We claim:

1. A shutter drive mechanism for an floodlight, comprising:

a floodlight housing having first and second parallel rails extending along a front edge portion of said housing;

a drive veil extending from said housing wherein a drive arm is linearly moveable;

a planar shutter slidably disposed between said rails and connected to said drive arm;

a lens affixed to a front surface of said housing and between said housing and said planar shutter;

said shutter moving between open and closed positions;

said shutter having at least one position substantially inhibiting light emission from said floodlight housing.

2. The shutter drive mechanism of claim 1, further comprising a visor extending from a front portion of said housing.

3. The shutter drive mechanism claim 1, said drive veil extending upwardly from said housing.

4. The shutter drive mechanism of claim 1, said drive veil having a slot disposed therein extending longitudinally through said drive veil.

5. The shutter drive mechanism of claim 1, said drive veil having a substantially tear drop shaped cross-section.

6. The shutter drive mechanism of claim 1, said drive arm extending through a slot in said drive veil.

7. The shutter drive mechanism of claim 1, said planar shutter extending between first and second slides.

8. The shutter drive mechanism of claim 7, said first slide and said second slide located within said rails.

9. The shutter drive mechanism of claim 1, said drive arm being operated by a motor.

10. The shutter drive mechanism of claim 9, said motor being a ½ horsepower motor.

11. The shutter drive mechanism of claim 9, further comprising a screw-drive operably connecting said motor and to a runner.

12. The shutter drive mechanism of claim 9, further comprising a chain drive operably connecting said motor and a runner.

13. The shutter drive mechanism of claim 1, further comprising a runner guide extending longitudinally through said drive veil and a runner linearly moveable along said runner guide.

14. The shutter drive mechanism of claim 13, said runner guide further comprising first and second limit switches.

15. The shutter drive mechanism of claim 14, said first limit switch being an upper limit switch and said second switch being a lower limit switch.

16. A shutter drive mechanism for a floodlight, comprising:

a floodlight;

a housing adjacent said floodlight having a drive mechanism extending from an upper side of said housing;

said drive mechanism including a screw-drive extending from said housing;

a runner movably connected to said drive mechanism;

a drive arm fastened to said runner;

said drive arm connected at a distal end to a planar shutter;

said planar shutter extending between slides, each of said slides disposed within a rail disposed on a forward portion of said housing; and, a lens fixed between said shutter and said housing;

said planar shutter having at least one light blocking position for inhibiting light transmission from said floodlight.

17. The shutter drive mechanism of claim 16, said runner threadably attached to said screw drive for linear movement of said planar shutter.

18. The shutter drive mechanism claim 16, said runner disposed between first and second limit switches.

19. The shutter drive mechanism of claim 16, further comprising a light source behind said lens, said lens attached to a side of said housing.

20. The shutter drive mechanism of claim 16, further comprising a motor in said housing.

21. The shutter drive mechanism of claim 16, further comprising a visor extending from a lower portion of said rails.

22. The shutter drive mechanism of claim 16, said planar shutter movable in a vertical direction.

23. The shutter drive mechanism of claim 16, said planar shutter movable in a horizontal direction.

24. The shutter drive mechanism of claim 16, further comprising a drive veil disposed about said drive mechanism.

25. The shutter drive mechanism of claim 24, said drive veil having a slot therein through which said drive arm extends beyond said drive veil.

26. A shutter drive mechanism, comprising:

a luminaire housing having a substantially open portion and a lens extending across said open portion;

a first rail and a second rail located along corresponding first and second sides of said open portion;

a first slide and a second slide disposed within corresponding first and second rails, respectively;

a planar shutter extending between said first and second slides and across said lens to substantially inhibit light emission;

a drive mechanism extending from said housing including a runner guide having a runner movably attached to said runner guide;

a drive arm fastened to said runner at a first end and attached to said planar shutter at a second end.

27. The shutter drive mechanism of claim 26, said rails being vertically oriented.

28. The shutter drive mechanism of claim 25, said rails being horizontally oriented.

29. The shutter drive mechanism of claim 26, further comprising a visor extending from said housing.

30. The shutter drive mechanism of claim 26, said runner guide having upper and lower limit switches defining a range of motion for said runner.

31. The shutter drive mechanism of claim 26, said housing having a motor disposed therein operably connected to said drive mechanism.

32. The shutter drive mechanism of claim 31, said motor operably connected to a screw drive, said runner threadably attached to said screw drive.

33. The shutter drive mechanism of claim 26, further comprising a drive veil covering said drive mechanism.

34. The shutter drive mechanism of claim 33, said drive veil having a slot extending longitudinally there through.

35. The shutter drive mechanism of claim 34, said drive arm extending through said slot.

* * * * *